US005906102A

United States Patent [19]

Bartlett et al.

[11] Patent Number: 5,906,102

[45] **Date of Patent: *May 25, 1999**

[54] CRYOPUMP WITH GAS HEATED EXHAUST VALVE AND METHOD OF WARMING SURFACES OF AN EXHAUST VALVE

[75] Inventors: Allen J. Bartlett, Mendon; Michael J. Eacobacci, Jr., Weymouth; Joseph P. Johnson, Stoughton, all of Mass.

[73] Assignee: Helix Technology Corporation, Mansfield, Mass.

[ * ] Notice: This patent issued on a continued prosecution application filed under 37 CFR 1.53(d), and is subject to the twenty year patent term provisions of 35 U.S.C. 154(a)(2).

[21] Appl. No.: 08/631,532

[22] Filed: Apr. 12, 1996

[51] Int. Cl.[6] ..... B01D 8/00

[52] U.S. Cl. ..... 62/55.5; 62/100; 62/116; 62/268; 62/500; 55/269

[58] Field of Search ..... 65/55.5, 303; 417/901; 137/339

[56] References Cited

U.S. PATENT DOCUMENTS

| | | | |
|---|---|---|---|
| 3,731,495 | 5/1973 | Coveney | 62/651 |
| 3,900,043 | 8/1975 | Bowen et al. | 137/101.21 |
| 4,269,147 | 5/1981 | Vorbeck | 119/73 |
| 4,339,927 | 7/1982 | Sarcia | 62/6 |
| 4,361,418 | 11/1982 | Tsheppe | 417/54 |
| 4,555,907 | 12/1985 | Bartlett | 62/55.5 |
| 4,628,748 | 12/1986 | Jogan et al. | 73/863.01 |
| 4,878,354 | 11/1989 | Stearns et al. | 62/63 |
| 5,131,440 | 7/1992 | Quinn | 141/63 |
| 5,137,050 | 8/1992 | Clarke et al. | 137/541 |
| 5,165,246 | 11/1992 | Cipolla et al. | 62/47.1 |
| 5,209,764 | 5/1993 | Eberling | 55/162 |
| 5,301,723 | 4/1994 | Goode | 141/82 |

FOREIGN PATENT DOCUMENTS

| | | |
|---|---|---|
| 0250613 | 1/1988 | European Pat. Off. . |
| 60-98690 | 6/1985 | Japan . |
| 04148084 | 9/1992 | Japan . |
| 05272452 | 1/1994 | Japan . |
| 8605240 | 9/1986 | WIPO . |
| 92/08894 | 5/1992 | WIPO . |

*Primary Examiner*—Henry A. Bennett
*Assistant Examiner*—Pamela A. Wilson
*Attorney, Agent, or Firm*—Hamilton, Brook, Smith & Reynolds, P.C.

[57] ABSTRACT

A cryopump having a cryopump chamber includes a purge gas valve coupled to the cryopump chamber for supplying a first quantity of warm gas to the cryopump chamber in order to purge the cryopump chamber during regeneration. A roughing valve couples the cryopump chamber to a roughing pump enabling the cryopump chamber to be roughed. An exhaust valve is coupled to the cryopump chamber for exhausting gases from the cryopump chamber during purge. A delivery valve is coupled to the exhaust valve for delivering a second quantity of warm gas directly onto surfaces of the exhaust valve for warming the surfaces of the exhaust valve.

25 Claims, 3 Drawing Sheets

CRYOPUMP WITH GAS HEATED EXHAUST VALVE AND METHOD OF WARMING SURFACES OF AN EXHAUST VALVE

BACKGROUND

Cryogenic vacuum pumps, or cryopumps, currently available generally follow a common design concept. A low temperature array, usually operating in the range of 4 to 25 K, is the primary pumping surface. This surface is surrounded by a higher temperature radiation shield, usually operated in the temperature range of 60 to 130 K, which provides radiation shielding to the lower temperature array. The radiation shield generally comprises a housing which is closed except at a frontal array positioned between the primary pumping surface and a work chamber to be evacuated.

In operation, high boiling point gases such as water vapor are condensed on the frontal array. Lower boiling point gases pass through that array and into the volume within the radiation shield and condense on the lower temperature array. A surface coated with an adsorbent such as charcoal or a molecular sieve operating at or below the temperature of the colder array may also be provided in this volume to remove the very low boiling point gases such as hydrogen. With the gases thus condensed and/or adsorbed onto the pumping surfaces, a vacuum is created in the work chamber.

In systems cooled by closed cycle coolers, the cooler is typically a two-stage refrigerator having a cold finger which extends through the rear or side of the radiation shield. High pressure helium refrigerant is generally delivered to the cryocooler through high pressure lines from a compressor assembly. Electrical power to a displacer drive motor in the cooler is usually also delivered through the compressor or a controller assembly.

The cold end of the second, coldest stage of the cryocooler is at the tip of the cold finger. The primary pumping surface, or cryopanel, is connected to a heat sink at the coldest end of the second stage of the cold finger. This cryopanel may be a simple metal plate or cup or an array of metal baffles arranged around and connected to the second-stage heat sink. This second-stage cryopanel also supports the low temperature adsorbent.

The radiation shield is connected to a heat sink, or heat station, at the coldest end of the first stage of the refrigerator. The shield surrounds the second-stage cryopanel in such a way as to protect it from radiant heat. The frontal array is cooled by the first-stage heat sink by attachment to the radiation shield or, as disclosed in U.S. Pat. No. 4,356,810, through thermal struts.

After several days or weeks of use, the gases which have condensed onto the cryopanels, and in particular the gases which are adsorbed, begin to saturate the cryopump. A regeneration procedure must then be followed to warm the cryopump and thus release the gases and remove the gases from the system. As the gases evaporate, the pressure in the cryopump increases, and the gases are exhausted through a relief or exhaust valve. During regeneration, the cryopump is often purged with warm nitrogen gas. The nitrogen gas hastens warming of the cryopanels and also serves to flush water and other vapors from the cryopump. Nitrogen is the usual purge gas because it is relatively inert, and is available free of water vapor. It is usually delivered from a nitrogen storage bottle through a transfer line and a purge valve coupled to the cryopump.

After the cryopump is purged, it must be rough pumped to produce a vacuum around the cryopumping surfaces and cold finger which reduces heat transfer by gas conduction and thus enables the cryocooler to cool to normal operating temperatures. The roughing pump is generally a mechanical pump coupled through a fluid line to a roughing valve mounted to the cryopump.

Control of the regeneration process is facilitated by temperature sensors coupled to the cold finger heat stations. Thermocouple pressure gauges have also been used with cryopumps. Although regeneration may be controlled by manually turning the cryocooler off and on and manually controlling the purge and roughing valves, a separate regeneration controller is used in more sophisticated systems. Wires from the controller are coupled to each of the sensors, the cryocooler motor and the valves to be actuated. A cryopump having an integral electronic controller is presented in U.S. Pat. No. 4,918,930.

In a fast regeneration process, the second stage of the cryopump is heated as purge gas is applied to the cryopump. As the second stage of the cryopump is warmed, the gases trapped at the second stage are released and exhausted through a relief valve.

A problem sometimes encountered during the fast regeneration process is that some of the gases exhausted through the exhaust valve (such as nitrogen) freeze the surfaces of the exhaust valve. The frozen surfaces can prevent the exhaust valve from sealing properly, thereby affecting the performance of the cryopump.

SUMMARY OF THE INVENTION

The present invention provides a method of warming the frozen surfaces of an exhaust valve in which the exhaust valve is coupled to a cryopump chamber of a cryopump. Warm gas is delivered onto surfaces of the exhaust valve with a delivery conduit. The delivery conduit has a delivery end positioned proximate to the surfaces of the exhaust valve. The warm gas warms the surfaces of the exhaust valve allowing the exhaust valve to re-seal.

The present invention also provides a cryopump including a cryopump chamber and a purge valve coupled to the cryopump chamber. When open, the purge valve delivers a first quantity of warm gas to the cryopump chamber for purging the cryopump chamber during regeneration. A roughing valve couples the cryopump chamber to a roughing pump which when open, enables the cryopump chamber to be rough pumped. An exhaust valve is coupled to the cryopump chamber for exhausting gases from the cryopump chamber when the cryopump chamber is purged. A delivery valve is coupled to the exhaust valve for delivering a second quantity of warm gas onto surfaces of the exhaust valve for warming the exhaust valve and removing frozen gases trapped on the surfaces of the exhaust valve.

In preferred embodiments, the cryopump further includes a refrigerator for cooling condensation and adsorption surfaces within the cryopump chamber. A housing substantially encloses the exhaust valve for directing the pump effluent to a remote exhaust line. The housing also serves to support a delivery conduit and delivery valve. The delivery conduit couples the delivery valve to the exhaust valve housing and has a delivery end positioned proximate to the surfaces of the exhaust valve.

The roughing valve is preferably gas operated with a pilot valve controllably delivering pressurized gas to the roughing valve for controlling the operation of the roughing valve. A controller controls the roughing valve by means of the pilot valve and also controls the purge valve and delivery valve. The controller causes the roughing valve and the delivery valve to open at about the same time by using the same signal for causing the roughing valve and the delivery valve to open. This allows the cryopump chamber to be roughed at the same time the second quantity of warm gas is delivered to the surfaces of the exhaust valve. A purge gas source supplies warm nitrogen gas to the cryopump chamber, the purge valve, the delivery valve and the pilot valve.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION OF A PREFERRED EMBODIMENT

Figure 1:
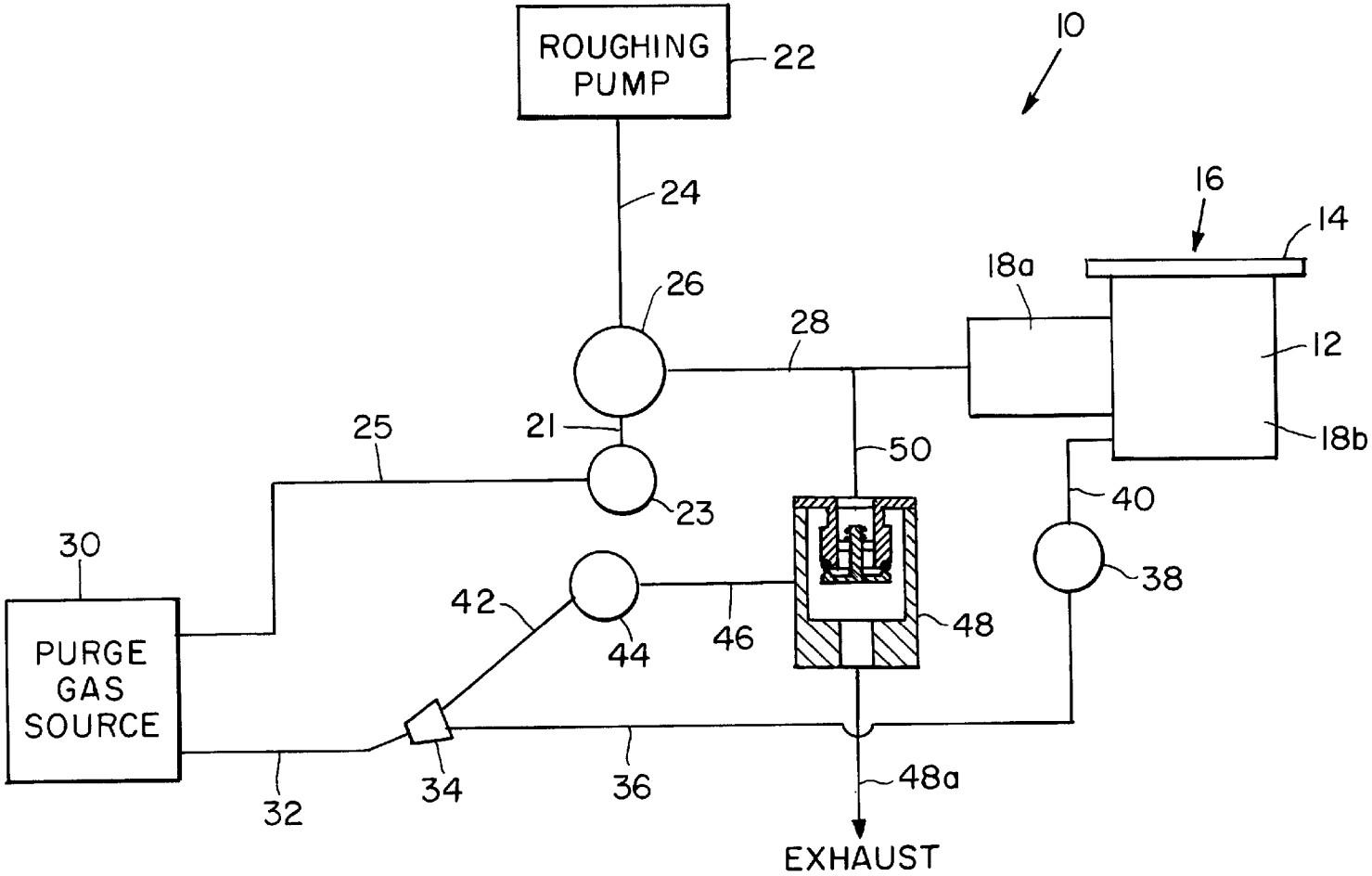
FIG. 1 is a schematic drawing of the present invention cryopump.
Figure 2:
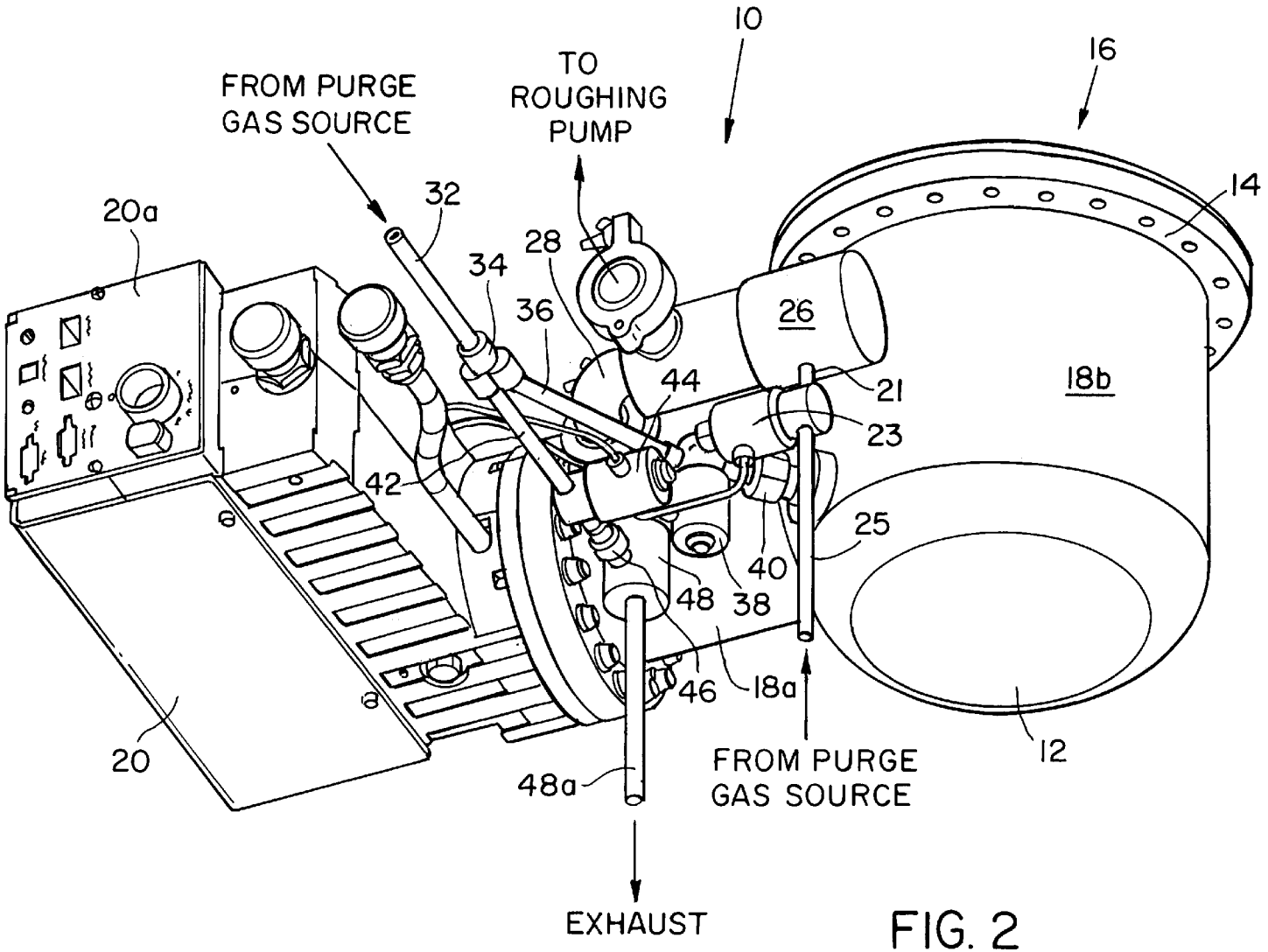
FIG. 2 is a perspective view of the present invention cryopump.

Referring to FIGS. 1 and 2, cryopump 10 includes a cryopump chamber 12 which may be mounted to the wall of a work chamber along a flange 14. The cryopump chamber 12 has a frontal opening 16 which communicates with a circular opening in the work chamber. A two stage cold finger of a refrigerator is housed within portion 18*a* of cryopump chamber 12 and protrudes into portion 18*b* of cryopump chamber 12. A two-stage displacer in the cold finger is driven by a motor contained within housing 20. The cryopump chamber 12 is similar to that disclosed in U.S. Pat. No. 4,555,907.

An exhaust valve 48 is coupled to portion 18*a* of cryopump chamber 12 via conduit 50 and conduit 28. Exhaust valve 48 vents or exhausts gases released from cryopump chamber 12 when cryopump 10 is purged during regeneration.

A purge gas source 30 is coupled to portion 18*b* of cryopump chamber 12 via conduit 32, connector 34, conduit 36, purge valve 38 and conduit 40. Purge gas source 30 provides warm nitrogen gas at about 60 psi and 20° C. Purge valve 38 is preferably a solenoid valve which opens to deliver warm nitrogen gas from purge gas source 30 to cryopump chamber 12 in order to purge and regenerate cryopump 10.

Purge gas source 30 is also coupled to exhaust valve 48 via conduit 32, connector 34, conduit 42, delivery valve 44 and delivery conduit 46. Delivery valve 44 is preferably a solenoid valve which opens to deliver warm nitrogen gas from purge gas source 30 to surfaces of exhaust valve 48 in order to warm surfaces frozen during purge. Although warm nitrogen gas is preferably supplied to delivery valve 44 from purge gas source 30, alternatively, warm gas from a separate source can be used to supply delivery valve 44.

A roughing pump 22 is coupled to portion 18*a* of cryopump chamber 12 via conduit 24, roughing valve 26 and conduit 28. When open, roughing valve 26 permits cryopump chamber 12 to be roughed by roughing pump 22. Roughing valve 26 is a preferably a gas operated valve that is controlled by pilot valve 23. Pilot valve 23 is preferably a solenoid valve which is coupled to roughing valve 26 by connector 21. When open, pilot valve 23 supplies pressurized gas to roughing valve 26 which opens roughing valve 26. As a result, pilot valve 23 and roughing valve 26 open at about the same time. The pressurized gas is preferably nitrogen gas supplied to pilot valve 23 from purge gas source 30 via conduit 25. Alternatively, the pressurized nitrogen gas can be pressurized air.

Controller 20*a* controls the operation of cryopump 10, including the refrigerator motor, roughing pump 22, pilot valve 23, purge valve 38 and delivery valve 44. Controller 20*a* can be programmed to automatically initiate the regeneration process at preset intervals or when the cryopump chamber 12 is saturated. In addition, controller 20*a* can also initiate additional regeneration process steps such as a repurge if the conventional regeneration process is unable to remove enough trapped gases from cryopump chamber 12. Furthermore, controller 20*a* can initiate a re-delivery of warm gas to the surfaces of exhaust valve 48 for further warming of the frozen surfaces.

Figure 3:
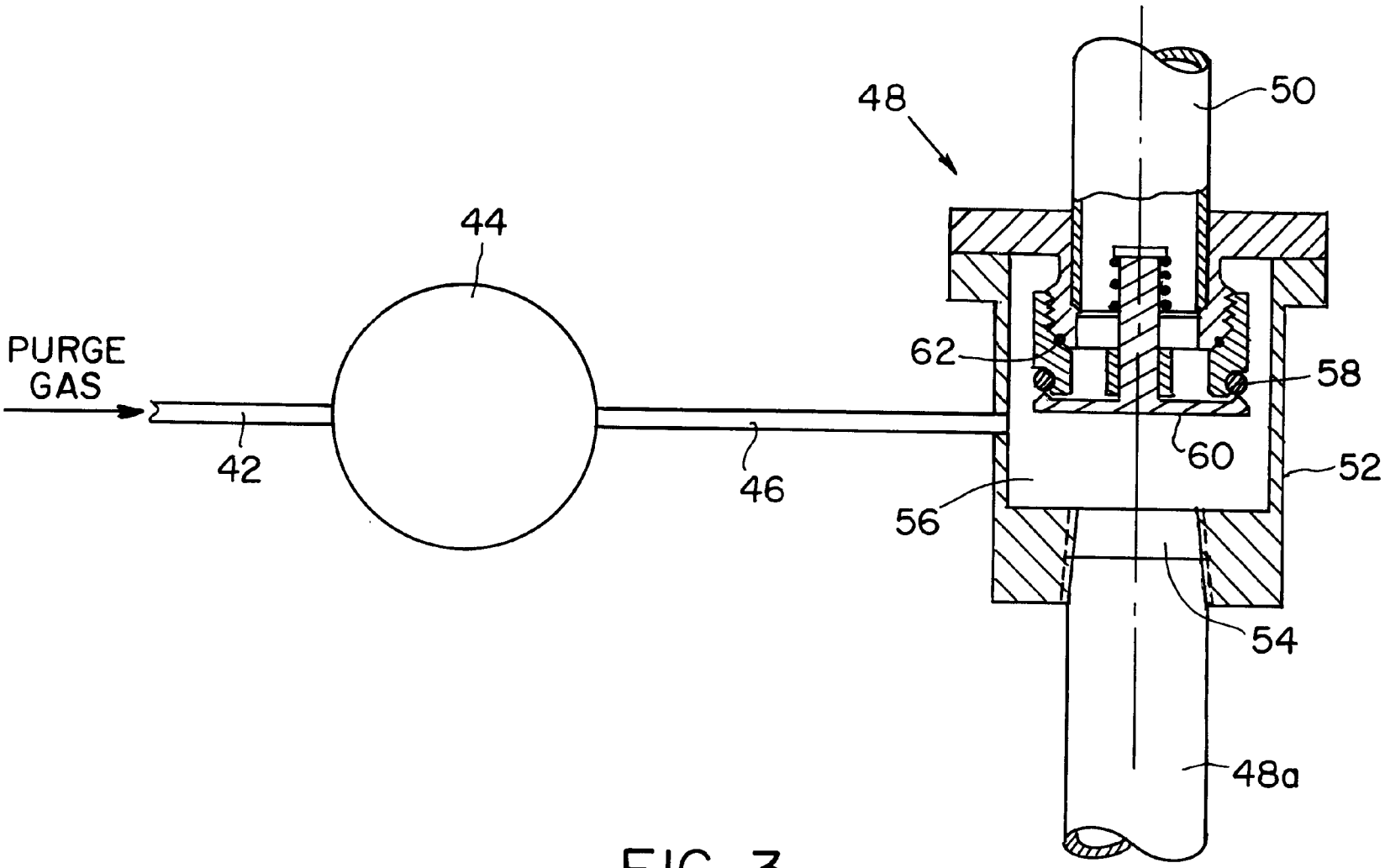
FIG. 3 is a partial side sectional view of the exhaust valve and delivery conduit for heating the exhaust valve.

FIG. 3 depicts exhaust valve 48 in greater detail. Exhaust valve 48 includes a valve assembly 62 having a spring loaded valve member 60 which closes and seals against an "O"-ring 58. Pressures within cryopump chamber 12 of about 1–2 psi above ambient pressure causes valve member 60 to open, thereby allowing gases to escape from cryopump chamber 12 between valve member 60 and "O"-ring 58. A housing 52 surrounds and thus substanially encloses valve assembly 62 and forms a chamber 56 therearound. An exit port 54 in housing 52 allows gases exhausted through valve assembly 62 to be vented to the atmosphere via conduit 48*a*. Delivery conduit 46 is coupled to housing 52 at a location near "O"-ring 58 and valve member 60 for delivering warm gas from purge gas source 30 onto the surfaces of the "O"-ring 58 and valve member 60. Housing 52 causes the warm gas to be directed more evenly about those surfaces. Valve assembly 62 is preferably similar to the valve disclosed in U.S. Pat. No. 5,137,050 but alternatively, other suitable pressure relief or exhaust valves can be employed.

In operation, in order to conduct a fast regeneration of cryopump 10, the cryogenic refrigerator of cryopump 10 is first turned off. Purge valve 38 is then opened for about 30 seconds to deliver warm nitrogen gas from purge gas source 30 into cryopump chamber 12 to warm and purge cryopump chamber 12. In addition, electrical heaters attached to the condensing and adsorbing surfaces of the cryopump are used to heat those surfaces. Pilot valve 23, roughing valve 26 and delivery valve 44 remain closed. As the cryopumping surfaces within cryopump chamber 12 warm, gases that are trapped on the cryopumping surfaces are released causing a pressure increase within cryopump chamber 12. This causes exhaust valve 48 to open and the released gases and cryogenic liquids along with the purge gas are exhausted to the atmosphere via conduit 28, conduit 50, exhaust valve 48 and conduit 48*a*.

Purge valve 38 then closes to terminate the purging of cryopump chamber 12. Pilot valve 23 opens and delivers pressurized nitrogen gas from purge gas source 30 to roughing valve 26. The pressurized nitrogen gas opens roughing valve 26 and cryopump chamber 12 is roughed by roughing pump 22 for about 15 minutes to a preset base pressure such as 75 or 100 microns.

Some of the gases and cryogenic liquids exhausted through exhaust valve 48 from cryopump chamber 12 during purge may freeze the valve member 60 and/or "O"-ring 58.

When this occurs, a tight seal is difficult to obtain between valve member 60 and "O"-ring 58 because "O"-ring 58 is rigid when frozen. Exhaust valve 48 typically provides the tightest seal when "O"-ring 58 is soft and pliable. In order to warm and soften "O"-ring 58, delivery valve 44 opens to deliver warm nitrogen gas from purge gas source 30 onto surfaces of valve assembly 62. The same low power control signal from controller 20*a* which opens pilot valve 23 is also used to open delivery valve 44. As a result, delivery valve 44 opens and closes at about the same time that pilot valve 23 and roughing valve 26 open and close. Housing 52 causes the warm purge gas to encircle valve assembly 62 and helps direct the warm purge gas evenly over the surfaces of valve assembly 62. The warm nitrogen gas warms and softens surfaces of valve assembly 62 including valve member 60 and/or "O"-ring 58, thereby allowing a tight seal to be formed therebetween. Once a tight seal is obtained, the roughing pump 22 is able to bring down the pressure within cryopump chamber 12 to the preset base pressure. Although delivery valve 44 typically remains open for the same duration that roughing valve 26 remains open, alternatively, a timer can be used on delivery valve 44 so that warm gas can be delivered onto surfaces of valve assembly 62 for a longer or shorter amount of time.

When the pressure within cryopump chamber 12 reaches the preset level, pilot valve 23, roughing valve 26 and delivery valve 44 are closed. The refrigerator of cryopump 10 is then allowed to cool to operating temperature and cryopumping begins. Once the cryopanels of cryopump 10 are again saturated with condensed gases, another regeneration process is performed.

If the pressure within cryopump chamber 12 during rough pumping does not reach the preset level within a certain specified time, controller 20*a* can be programmed to initiate another purge cycle. In addition, controller 20*a* can also initiate the re-delivery of warm gas onto the surfaces of valve assembly 62 to further warm frozen surfaces.

Using the same low power control signal from controller 20*a* to open and close the roughing valve 26 (via pilot valve 23) and delivery valve 44 allows existing cryopumps to be easily modified into the present invention cryopump 10. Furthermore, such an arrangement allows warming of valve assembly 62 through the delivery of warm gas thereon without requiring the addition of a high power electrical heater on the exhaust valve. An electrical heater requires between about 50 to 100 watts of power for operation. Controller 20*a* is able to provide the few watts of electrical energy required to operate delivery valve 44 and warm gas from purge gas source 30 is already available.

Equivalents

While this invention has been particularly shown and described with references to preferred embodiments thereof, it will be understood by those skilled in the art that various changes in form and details may be made therein without departing from the spirit and scope of the invention as defined by the appended claims.

For example, the present invention is not intended to be limited to a cryopump of the style depicted in the drawings. The present invention is intended to include all cryopumps which direct warm gas onto the exhaust valve for warming the valve. Although valves 23, 38 and 44 are preferably solenoid valves, alternatively, those valves can be gas operated or even manually operated. Additionally, roughing valve 26 can be solenoid or manually operated. In such a case, pilot valve 23 is omitted. Furthermore, purge gas source 30 can supply suitable purge gases other than nitrogen. Also, controller 20*a* can initiate other regeneration processes such as those described in U.S. Ser. No. 08/619,131, filed Mar. 20, 1996, which is incorporated herein by reference in its entirety.

What is claimed is:

1. A method of warming the surfaces of an exhaust valve, the exhaust valve being coupled to a cryopump chamber of a cryopump for exhausting gases from the cryopump chamber during regeneration, the cryopump having a purge gas source for directing purge gas into the cryopump chamber, the method comprising the step of delivering and directing a warm gas from the purge gas source onto surfaces of the exhaust valve with a delivery conduit, the delivery conduit having a delivery end facing and positioned proximate said surfaces of the exhaust valve, the warm gas warming said surfaces of the exhaust valve.

2. The method of claim 1 further comprising the steps of:

coupling a delivery valve to said delivery conduit; and opening the delivery valve to supply the warm gas to the delivery conduit.

3. The method of claim 1 further comprising the step of substantially enclosing the exhaust valve within a housing, the housing directing the delivered warm gas around the surfaces of the exhaust valve.

4. A method of regenerating a cryopump chamber of a cryopump comprising the steps of:

opening a purge valve to deliver a first quantity of warm gas to the cryopump chamber for applying a gas purge to the cryopump chamber, the first quantity of gas warming cryopumping surfaces of the cryopump chamber to temperatures high enough to release trapped gases from the cryopumping surfaces;

exhausting the released trapped gases from the cryopump chamber through an exhaust valve; and opening a delivery valve to deliver a second quantity of warm gas onto surfaces of the exhaust valve, the warm gas warming said surfaces of the exhaust valve.

5. The method of claim 4 further comprising the step of supplying the first quantity of warm gas to the purge valve and the second quantity of warm gas to the delivery valve from a purge gas source.

6. The method of claim 4 further comprising the steps of:

opening a roughing valve to a roughing pump to couple the cryopump chamber to the roughing pump after applying the gas purge;

roughing the cryopump chamber with the roughing pump; and closing the purge valve.

7. The method of claim 4 further comprising the steps of:

opening a roughing valve to a roughing pump to couple the cryopump chamber to the roughing pump;

roughing the cryopump chamber with the roughing pump at the same time the second quantity of warm gas is delivered to the surfaces of the exhaust valve; and closing the purge valve.

8. The method of claim 4 further comprising the step of cooling the cryopump chamber with a refrigerator.

9. The method of claim 4 further comprising the step of coupling the delivery valve to the exhaust valve with a delivery conduit, the delivery conduit having a delivery end positioned proximate to surfaces of the exhaust valve.

10. The method of claim 4 further comprising the step of substantially enclosing the exhaust valve within a housing for directing the delivered warm gas more evenly onto the surfaces of the exhaust valve.

11. A cryopump comprising:

a cryopump chamber;

a purge valve coupled to the cryopump chamber for delivering a first quantity of warm gas to the cryopump chamber for purging the cryopump chamber;

a roughing valve for coupling the cryopump chamber to a roughing pump;

an exhaust valve coupled to the cryopump chamber for exhausting gases from the cryopump chamber; and a delivery valve coupled to the exhaust valve for delivering a second quantity of warm gas onto surfaces of the exhaust valve to warm the exhaust valve.

12. The cryopump of claim 11 further comprising a controller for controlling the purge valve, the delivery valve and the roughing valve during a regeneration process of the cryopump.

13. The cryopump of claim 12 in which the controller causes the roughing valve and the delivery valve to open at about the same time.

14. The cryopump of claim 13 in which the controller provides a low power control signal for causing the opening of the roughing valve and the delivery valve.

15. The cryopump of claim 11 further comprising a housing substantially enclosing the exhaust valve for directing the second quantity of warm gas more evenly onto the surfaces of the exhaust valve.

16. The cryopump of claim 15 further comprising a delivery conduit coupling the delivery valve to the exhaust valve housing.

17. The cryopump of claim 11 further comprising a refrigerator for cooling the cryopump chamber.

18. The cryopump of claim 11 in which the roughing valve is gas operated.

19. The cryopump of claim 18 further comprising a pilot valve for controllably delivering gas to the roughing valve for controlling the roughing valve.

20. The cryopump of claim 18 further comprising a purge gas source for supplying gas to the cryopump chamber, the delivery valve and the pilot valve.

21. An exhaust valve for coupling to a cryopump chamber of a cryopump for exhausting gases from the cryopump chamber during regeneration, the exhaust valve comprising:

a valve assembly for exhausting gases;

a housing substantially enclosing the valve assembly; and a delivery conduit coupled to the housing facing the valve assembly for delivering and directing warm gas to surfaces of the valve assembly to warm the valve assembly, the housing directing the warm gases around the surfaces of the valve assembly.

22. An exhaust valve comprising:

a valve assembly for exhausting gases, the valve assembly including a valve member that is spring loaded against an elastomer seal;

a housing substantially enclosing the valve assembly; and a delivery conduit coupled to the housing facing the valve assembly for delivering and directing warm gas to surfaces of the valve assembly to warm the valve assembly, the housing directing the warm gases around the surfaces of the valve assembly.

23. A method of warming the surfaces of an exhaust valve, the exhaust valve being coupled to a cryopump chamber of a cryopump for exhausting gases from the cryopump chamber during regeneration, the method comprising the steps of:

coupling a delivery valve to a delivery conduit;

opening the delivery valve to supply a warm gas to the delivery conduit; and delivering the warm gas onto surfaces of the exhaust valve with the delivery conduit, the delivery conduit having a delivery end positioned proximate said surfaces of the exhaust valve, the warm gas warming said surfaces of the exhaust valve.

24. The method of claim 23 further comprising the step of providing the warm gas from a purge gas source.

25. The method of claim 23 further comprising the step of substantially enclosing the exhaust valve within a housing, the housing directing the delivered warm gas around the surfaces of the exhaust valve.

* * * * *